United States Patent [19]

Casull

[11] 4,402,152

[45] Sep. 6, 1983

[54] BOLT MECHANISM AND RECEIVER FOR BOLT ACTION RIFLE

[76] Inventor: Richard J. Casull, P.O. Box 276, Freedom, Wyo. 83120

[21] Appl. No.: 224,092

[22] Filed: Jan. 12, 1981

[51] Int. Cl.[3] ..... F41C 11/00; F41C 15/00

[52] U.S. Cl. ..... 42/16; 42/25; 42/75 B

[58] Field of Search ..... 42/16, 25, 75 B

[56] References Cited

U.S. PATENT DOCUMENTS

| | | | |
|---|---|---|---|
| 2,950,653 | 8/1960 | Harvey | 42/25 X |
| 3,027,672 | 4/1962 | Sullivan | 42/16 |
| 3,696,542 | 10/1972 | Ekfeldt et al. | 42/16 |

FOREIGN PATENT DOCUMENTS

| | | | |
|---|---|---|---|
| 230692 | 7/1960 | Australia | 42/25 |
| 637801 | 11/1936 | Fed. Rep. of Germany | 42/25 |
| 1703549 | 8/1973 | Fed. Rep. of Germany | 42/75 B |

*Primary Examiner*—Charles T. Jordan
*Assistant Examiner*—Ted L. Parr
*Attorney, Agent, or Firm*—Terry M. Crellin; B. Deon Criddle

[57] ABSTRACT

A bolt action firearm incorporating a bolt head member attached to the head end of the bolt, with an extractor ring secured between the end of the bolt and the bolt head such that the extractor ring firmly retains the extractor within a recessed slot in the bolt head. The bolt head member is adapted to engage a locking ring which is, in turn, securely held in place in the receiver by the barrel.

3 Claims, 3 Drawing Figures

BOLT MECHANISM AND RECEIVER FOR BOLT ACTION RIFLE

BACKGROUND OF THE INVENTION

1. Field

This invention relates to bolt action type firearms and, in particular, to the receiver assembly of such firearms.

2. State of the Art

Bolt action rifles conventionally have an extractor associated with the bolt mechanism for extracting spent casings from the firing chamber as the bolt is withdrawn to its retracted position. Heretofore, complex, costly machining techniques have been required to incorporate the extractor in the head end of the bolt. In addition, the mechanism employed to lock the bolt in its closed, ready-to-fire position has conventionally required heat treatment of the entire receiver to provide strength for the bolt locking mechanism. Heat treatment of the receiver is costly and causes warpage of the receiver which results in a substantial reject rate for the heat treated receivers.

Objectives

A principal objective of the present invention is to provide a unique, novel mechanism and method for retaining the extractor in its operable position in the bolt assembly of a bolt action type firearm. An additional objective is to provide a reliable simple, and low cost bolt assembly having a separate bolt head incorporating a novel manner of retaining the extractor. A further objective of the invention is to provide an improved receiver mechanism in which a locking ring is provided in combination with the receiver and barrel for locking the bolt in its closed or ready-to-fire position so that heat treatment of the receiver is not necessary.

SUMMARY OF THE INVENTION

The above and other objectives of the present invention are achieved in a bolt action firearm in which the bolt is designed to have a separate bolt head member rigidly attached to the head end of the bolt. The bolt need not be heat treated. Only the bolt head member is heat treated. The bolt assembly is also provided with an extractor ring secured firmly between the end of the bolt and the bolt head. The extractor ring is adapted to securely retain the extractor within a recessed slot in the bolt head. The extractor ring and slotted bolt head are simple in design and readily machined at relatively low cost, and the assembly of the bolt mechanism is simple and cost efficient.

To avoid costly heat treatment of the receiver portion of the firearm, a novel, unique method and means have been devised for engaging or locking the bolt in its closed or ready-to-fire position. A locking ring, which is heat treated, is designed to be securely held in position in the receiver by the barrel of the firearm. The bolt head member of the bolt mechanism is adapted to engage the locking ring when the bolt is moved to its closed position. The heat treated locking ring provides more than adequate strength to the combined mechanism without requiring costly heat treatment of the receiver. The assembly of the barrel, receiver, and locking ring is simple and requires no more labor or capital equipment than presently used in assembling the barrel to the receiver.

Additional objects and features of the invention will become apparent from the following detailed description taken together with the accompanying drawings.

THE DRAWINGS

An embodiment representing the best mode presently contemplated of carrying out the invention is illustrated in the accompanying drawings, in which.

DETAILED DESCRIPTION OF THE ILLUSTRATED EMBODIMENT

Figures 1, 2, 3:
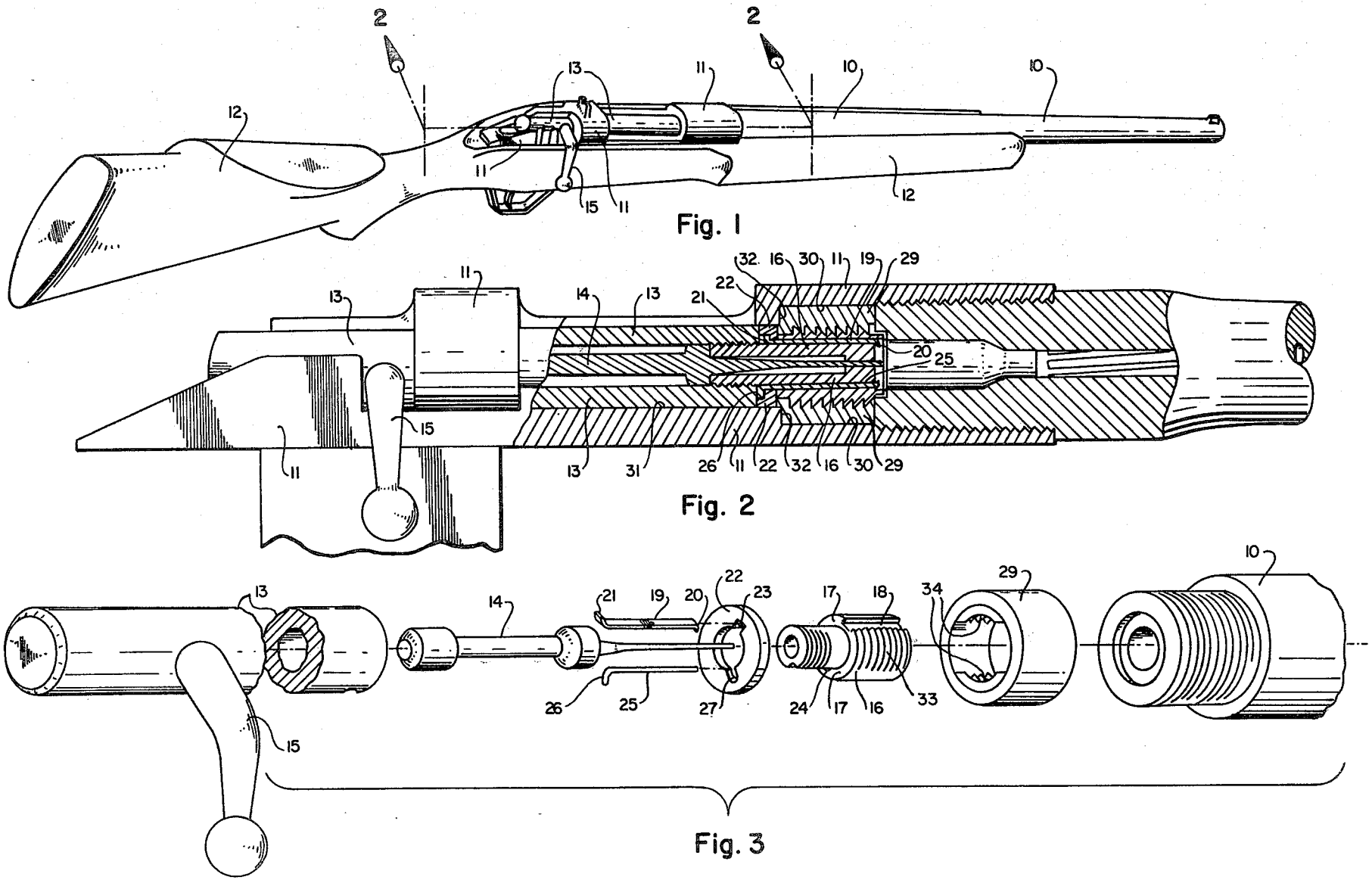
FIG. 1 is a pictorial view of a rifle incorporating the improved bolt mechanism of the present invention.
FIG. 2 is a partial cross-sectional view through the bolt, receiver and base end of the barrel of the rifle of FIG. 1 taken along line 2—2 of FIG. 1.
FIG. 3 is an exploded perspective showing the bolt, bolt head, locking ring, and barrel of the rifle shown in FIGS. 1 and 2.

In a preferred embodiment of the invention as illustrated in the drawings, a bolt action rifle is provided having an elongate barrel 10 and an action or receiver 11 attached to the rear end or base end of the barrel 10. The action or receiver 11 and barrel 10 are mounted on a gun stock 12.

As conventional in a bolt action rifle, the bolt 13 is received in a bore in the receiver 11. A firing pin 14 is positioned within a longitudinal bore in the bolt 13. The bolt 13 is movable from a retracted position not shown in the drawings to be a closed or ready-to-fire position as shown in the drawings. For purpose of moving the bolt 13, a bolt lever 15 is provided on the bolt as customary.

In accordance with the present invention, an improved assembly is provided at the head end of the bolt and in the assembly of the barrel and receiver. A bolt head 16 is provided having an externally threaded end portion which is adapted to be received in an internally threaded bore in the head end of the bolt 13. As best illustrated in FIG. 3, the other end portion of the bolt head 16 has an enlarged diameter so as to form a shoulder 17 around the periphery of the bolt head 16 between the threaded portion and enlarged portion thereof. An elongate recessed slot 18 (FIG. 3) is provided in the surface of the enlarged portion of the bolt head, extending from the shoulder 17 at the inner end of the enlarged portion of the bolt head 16 to the opposite end of the enlarged portion.

An elongate extractor member 19 is adapted to be positioned longitudinally within the recessed slot 18 in the enlarged portion of the bolt head 16. The extractor is advantageously made of a narrow, flat, relatively thin strip of metal which has a downwardly turned tang or hook 20 at the free end of the enlarged portion of the bolt head 16. As customary with bolt action rifles, the tang or hook 20 engages the rim of the cartridge when the bolt 13 is in its closed or ready-to-fire position. When the bolt is retracted, the tang or hook 20 pulls the spent cartridge from the firing chamber so that a loaded cartridge can be positioned in the rifle. The extractor member of the present invention also has an upwardly turned tang 21 at its other end, i.e., the end which is located approximate the threaded portion of the bolt head 16 and forms the shoulder 17.

The extractor member is securely retained within the recessed slot 18 by a retaining ring 22 when the retaining ring 22 and bolt head are assembled to the end of the bolt 13. The retaining ring 22 is adapted to fit over the threaded end portion of the bolt head 16 and abut the shoulder 17 formed by the inner end of the enlarged end portion of the bolt head 16. The retaining ring 22 has a notch 23 (FIG. 3) in its inside surface which receives the upturned tang 21 of the extractor member 19. When the retaining ring 22 is in place abutting the shoulder 17, the extractor member 19 is, thus, held securely in the recessed slot 18 in the bolt head 16. The bolt head is threaded into the threaded bore in the end of the bolt 13 so that the retaining ring 22 is held firmly between the head end of the bolt 13 and the shoulder 17 formed by the enlarged end portion of the bolt head 16.

A distinct advantage of the bolt head assembly of the present invention is in the simplicity of the construction and the means of retaining the extractor member 19 in the bolt head 16 so that the bolt head 16 can be made separate from the bolt 13 itself. By making the bolt head 16 separate from the bolt 13, heat treatment of the bolt 13 is not necessary. All that need be heat treated is the bolt head 16. This greatly reduces the cost of making the bolt assembly.

In addition to the extractor member 19, the bolt head 16 is advantageously provided with a shell ejector means. As illustrated, the ejector means comprises an elongate, pin-receiving opening 24 through the enlarged portion of the bolt head 16 so as to extend from the shoulder 17 to the other end of the enlarged portion of the bolt head 16. An elongate pin member 25 is positioned longitudinally within the pin-receiving opening as best shown in FIG. 2. The pin member 25 has an upturned tang 26 at its end which is approximate to the threaded portion of the bolt head 16. The tang 26 is received in a notch 27 (FIG. 3) in the inside surface of the retaining ring 22, whereby the pin member 25 is securely retained in the opening 24 through the bolt head 16 when the bolt head 16 and retaining ring 22 are assembled to the bolt 13 as described above and shown in FIG. 2.

The end of the pin member 25 opposite the tang 26 extends slightly beyond the end of the bolt head 16 and abuts the end of a shell casing when the shell is positioned in the firing chamber and the bolt 13 is in its closed or ready-to-fire position. The pin member 25 acts as a spring and exerts a spring force on the casing so that the casing is ejected from the ejector opening in the receiver by the spring force of the pin member 25 when the bolt 13 is withdrawn from its closed position and extracts the shell from the casing.

The invention further comprises an improvement in the assembly of the barrel 10 to the action or receiver 11 and in making the receiver 11 and especially the portion of the receiver which is adapted to make locking engagement with the head end of the bolt 13. In accordance with the present invention, the end of the rifle barrel 10 which is attached to the receiver 11 has external threads and is adapted to be received in an internally threaded bore in the receiver 11 as is well known in the art. Heretofore, the receiver has been formed as an integral member incorporating locking means for locking the head end of the bolt 13 in place when the bolt 13 is in its closed position. This requires heat treatment of the entire action or receiver 11. The heat treatment is costly inasmuch as a high reject rate is experienced due to warpage of the elongate, tubular receivers 11 during the heat treatment. In accordance with the present invention, the heat treatment of the entire receiver 11 is eliminated, and a locking ring 29 is provided. The locking ring 29 is securely held in place at the end of the barrel 10 as illustrated and explained below. The locking ring 29 must be heat treated, but the heat treatment is much less costly than heat treatment of the entire action or receiver 11.

As illustrated in FIG. 2, a counterbore 30 extends inwardly from the threaded bore in the receiver 11, with the bolt-receiving bore 31 in the receiver 11 extending inwardly from the counterbore 30. The bolt-receiving bore 31 has a diameter less than that of the counterbore 30 so as to form a concentric abutment 32 at the end of the bolt-receiving bore 31 adjacent to the counterbore 30. The locking ring 29 is positioned concentrically within the counterbore 30 so as to be forced into engagement with the abutment 32 at its one end and the threaded end of the rifle barrel 10 at its other end when the rifle barrel is threaded into the threaded bore in the receiver 11.

Means are provided for releasably securing the enlarged head end portion of the bolt head 16 to the locking ring 29 when the bolt 13 is moved from its retracted position to its forward or closed position in which the enlarged end portion of the bolt head 16 is received concentrically within the locking ring 29. As shown, the bolt head 16 has a pair of lug sections 33 located on opposite sides of the enlarged portion thereof. Each lug section comprises a series of parallel, sharp edged threads or projections. The internal surface of the locking ring 29 has a corresponding pair of internally threaded lug-receiving sections 34 on opposite sides thereof. The opposite facing inside surfaces located between the lug receiving sections 34 of the locking ring 29 are recessed so that the end of the bolt head 16 can be received within the locking ring 29 when the threaded lug sections 33 thereon are aligned with the recessed sections of the locking ring 29. When the bolt 13 is rotated at the end of its forward movement as is customary in bolt action rifles, the lug sections 33 on the bolt head 16 firmly engage the lug receiving sections 34 on the inside surface of the locking ring 29.

In making the receiver 11, the barrel-receiving bore is bored inwardly from one end of the elongate block which is to be the receiver. This bore is then provided with internal threads which are adapted to receive the threaded end of the barrel 10 as shown in FIG. 2. The counterbore 30 is bored concentrically inwardly from the barrel-receiving bore, and the bolt-receiving bore 31 is bored concentrically inwardly from the counterbore 30. The bolt-receiving bore 31 has a diameter less than that of the counterbore 30 so as to form the concentric abutment 32 at the end of the bolt-receiving bore 31 adjacent to the counterbore 30. In assembling the receiver 11 and barrel 10 together, the locking ring 29 is positioned within the counterbore 30. The end of the barrel 10 is threaded into the barrel-receiving bore so that the locking ring is held securely in place within the counterbore, with one end of the locking ring in engagement with the abutment 32 and the other end of the locking ring in engagement with the threaded end of the rifle barrel.

Although a preferred embodiment of my invention has been disclosed and illustrated herein, it is to be understood that the present disclosure is made by way of example and that variations are possible without departing from the subject matter I regard as my invention. In particular, a single action rifle has been described in detail; however, it is to be recognized that the invention is applicable to all bolt action type firearms including single action and automatic bolt action rifles, falling block rifles, and pistols utilizing a bolt type action.

I claim:

1. In a bolt action type firearm, in which the barrel of the firearm is attached to a receiver and a bolt is received in a bolt-receiving bore in the receiver, with the bolt having an extractor associated with the head end thereof for engaging the rim of a cartridge and extracting the cartridge from a chamber in the barrel when the bolt is withdrawn to its retracted position, an improved assembly at the head end of the bolt for retaining the extractor therein, said improved assembly comprising a bolt head having an externally threaded end portion adapted to be received in an internally threaded bore in the head end of the bolt, with the other end portion of the bolt head having an enlarged diameter so as to form a shoulder around the periphery of the bolt head between the threaded portion and the enlarged portion;

a recessed slot in the surface of the enlarged portion of the bolt head extending from the shoulder at the inner end of the enlarged portion to the opposite end of the enlarged portion;

an elongate extractor member adapted to be positioned longitudinally within the recessed slot in the enlarged portion of the bolt head, said extractor having an upturned tang at its end approximate the threaded portion of the bolt head; and a ring retaining member adapted to fit over the threaded end portion of the bolt head and abut the shoulder formed by the enlarged end portion of the bolt head, said ring retaining member having a notch in its inside surface to receiving the upturned tang of the extractor member, whereby when the bolt head is threaded into the threaded bore in the head end of the bolt, the ring retaining member is held firmly between the head end of the bolt and the shoulder formed by the enlarged end portion of the bolt head, and the extractor member is firmly retained within the recessed slot in the bolt head by the ring retaining member.

2. A firearm in accordance with claim 1, including the further improvement wherein the end of the barrel which is attached to the receiver has external threads which are received in an internally threaded bore in the receiver;

the threaded bore in which the end of the barrel is received has a concentric counterbore extending inwardly therefrom, with the bolt-receiving bore in said receiver extending inwardly from said counterbore, said bolt-receiving bore having a diameter less than the diameter of said counterbore so as to form a concentric abutment at the end of the bolt-receiving bore adjacent to said counterbore;

a locking ring is firmly positioned concentrically within said counterbore so as to be forced into engagement with the abutment at its one end and the threaded end of the barrel at its other end when the barrel is threaded into the threaded bore in said receiver; and means are provided for releasably securing the enlarged end portion of the bolt head to said locking ring when the bolt is moved from its retracted position to its forward position with the enlarged end portion of the bolt head received concentrically within said locking ring.

3. A firearm in accordance with claim 1, further including an elongate, pin-receiving opening bored through the enlarged portion of the bolt head so as to extend from the shoulder around the periphery of the bolt head to the other end of the enlarged portion of the bolt head;

an elongate pin member adapted to be positioned longitudinally within said pin-receiving opening, said pin member having an upturned tang at its end approximate to the threaded portion of the bolt head; and said ring retaining member having a second notch in its inside surface to receive the upturned tang of the pin member.

* * * * *